United States Patent [19]

Leyendecker et al.

[11] Patent Number: 4,800,813

[45] Date of Patent: Jan. 31, 1989

[54] PLANETARY TRANSMISSION DEVICE FOR DRIVING AN OSCILLATING AUXILIARY GRIPPER OF A PRINTING PRESS

[75] Inventors: Hans-Wilhelm Leyendecker, Obertshausen; Paul Abendroth, Offenbach am Main, both of Fed. Rep. of Germany

[73] Assignee: M.A.N. Roland, Offenbach am Main, Fed. Rep. of Germany

[21] Appl. No.: 65,847

[22] Filed: Jun. 24, 1987

[30] Foreign Application Priority Data

Jun. 6, 1986 [DE] Fed. Rep. of Germany ..... 3621385

[51] Int. Cl.[4] ..... B41F 21/05; B65H 5/10

[52] U.S. Cl. ..... 101/409; 271/82

[58] Field of Search ..... 101/409, 231; 271/82; 74/343, 394

[56] References Cited

U.S. PATENT DOCUMENTS

| | | | |
|---|---|---|---|
| 2,699,941 | 1/1955 | Huck et al. | 101/409 |
| 2,703,526 | 3/1955 | Hansson | 74/394 |
| 2,730,363 | 1/1956 | Dietrich et al. | 74/394 |
| 3,817,122 | 6/1974 | Lenoir et al. | 74/394 |
| 3,992,993 | 11/1976 | Kuhn et al. | 101/409 |
| 4,132,403 | 1/1979 | Weisbach et al. | 271/82 |
| 4,133,263 | 1/1979 | Schilling | 101/409 |
| 4,290,595 | 9/1981 | Thunker | 271/82 |
| 4,295,422 | 10/1981 | Thunker | 101/409 |

FOREIGN PATENT DOCUMENTS

| | | | |
|---|---|---|---|
| 135063 | 3/1985 | European Pat. Off. | 101/409 |
| 2220343 | 11/1972 | Fed. Rep. of Germany | 101/409 |
| 2166775 | 11/1975 | Fed. Rep. of Germany | 101/409 |
| 48401 | 1/1984 | Japan | 101/409 |
| 130048 | 11/1959 | U.S.S.R. . | |

*Primary Examiner*—William Pieprz

[57] ABSTRACT

A device for driving an oscillating auxiliary gripper of a printing press includes an eccentric shaft rotatably mounted in the side upright of the press and on the eccentric portion of which a cam-actuated auxiliary gripper shaft is rotatably mounted for oscillation thereon rotation with a driven gear being rigidly secured to the eccentric shaft and meshing permanently with a drive gear that rotates with the impression cylinder of the press is arranged to provide positively cooperating drive elements and coaxiality of the input and output shafts for introducing the desired additional motion superimposed upon the continuous rotation of the lifting eccentric of the auxiliary gripper. To this end, an auxiliary cam and main cam are rigidly secured to the eccentric shaft coaxially with the driven gear and are positively connected by way of a double cam follower lever having a pivoted connection in the frame and a pivoted connection through a crank link to the drive or input side of a differential planetary transmission on whose output side the auxiliary gripper shaft is rotatably disposed for oscillation on the eccentric portion of the rotating eccentric shaft.

2 Claims, 2 Drawing Sheets

PLANETARY TRANSMISSION DEVICE FOR DRIVING AN OSCILLATING AUXILIARY GRIPPER OF A PRINTING PRESS

FIELD OF THE INVENTION

The present invention relates generally to a device for driving an oscillating auxiliary gripper of a printing press, and more particularly concerns such a device including a planetary transmission drive.

BACKGROUND OF THE INVENTION

Devices for driving an oscillating auxiliary gripper of a printing press are widely known in the art. One embodiment of such a device is described, for example, in DE-PS No. 2,220,343. A disadvantage with this type of device is that non-positively cooperating drive elements are used to control the movement of the auxiliary gripper shaft. In operation a cam actuated in association with a spring presses a lever arm continuously onto a roller. Consequently, the non-positive elements are stressed very severely by the considerable mass forces which arise because of the high angular velocities and accelerations of the auxiliary gripper.

Another disadvantage is that control of the motion of the auxiliary gripper shaft calls for the use of input and output shafts whose center-axes are far apart from one another, leading to long linkages and, therefore, high mass forces. This consideration also applies to a camless drive of an oscillating auxiliary gripper such as is disclosed by EPA No. 0006402.

Other disadvantages are that the auxiliary gripper of such devices cannot be fully preassembled, and final assembly and replaceability are difficult as well.

OBJECTS AND SUMMARY OF THE INVENTION

Accordingly, it is the primary aim of the invention to provide a device of the kind hereinbefore set out with positively cooperating drive elements and a coaxial arrangement of the input and output shafts for introducing the additional motion superimposed on the continuous rotation of the lifting eccentric of the auxiliary gripper.

Pursuant to the invention, there is provided a device for driving an oscillating auxiliary gripper of a printing press having an eccentric shaft rotatably mounted in the side upright of the press and on which a cam-actuated auxiliary gripper shaft is mounted for rotation with a gear rigidly secured to the eccentric shaft and meshing permanently with a drive gear that rotates with the impression cylinder, wherein the eccentric shaft is rotatably mounted in a casing shell of said side upright, and cams in the form of an auxiliary cam and main cam are rigidly secured to the eccentric shaft and are positively connected by way of cam followers to a double cam follower lever having a pivoted connection in the frame and a pivoted connection in which a link rod is pivoted, said link rod being operatively connected by way of a pivoted connection to the drive or input side of a differential planetary transmission on whose output side the auxiliary gripper shaft is rotatably disposed on the eccentric shaft.

In the preferred embodiment, the differential planetary transmission includes a first externally toothed gear rotatably mounted on the eccentric shaft, and, offset therefrom by the amount of the eccentricity, a second externally toothed gear secured to the auxiliary gripper shaft and having an eccentric hub, and an internally toothed gear of the transmission rotatably mounted on the hub of the second externally toothed gear and in permanent mesh with the two externally toothed gears.

The advantage of the present invention is more particularly that mass forces are minimized and preassembly, final assembly and replaceability of the device are substantially improved.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
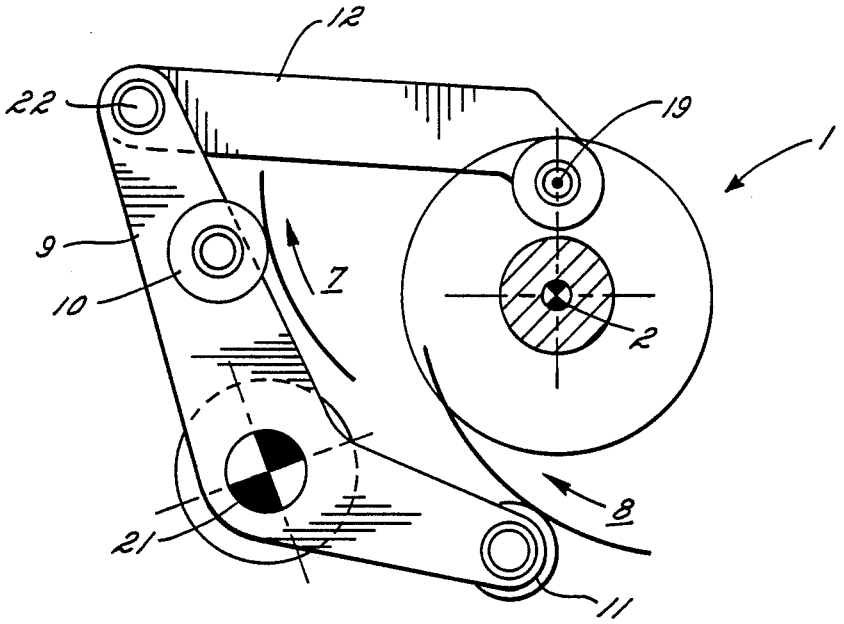
FIG. 1 is a diagrammatic view of the device in side elevation.
Figure 2:
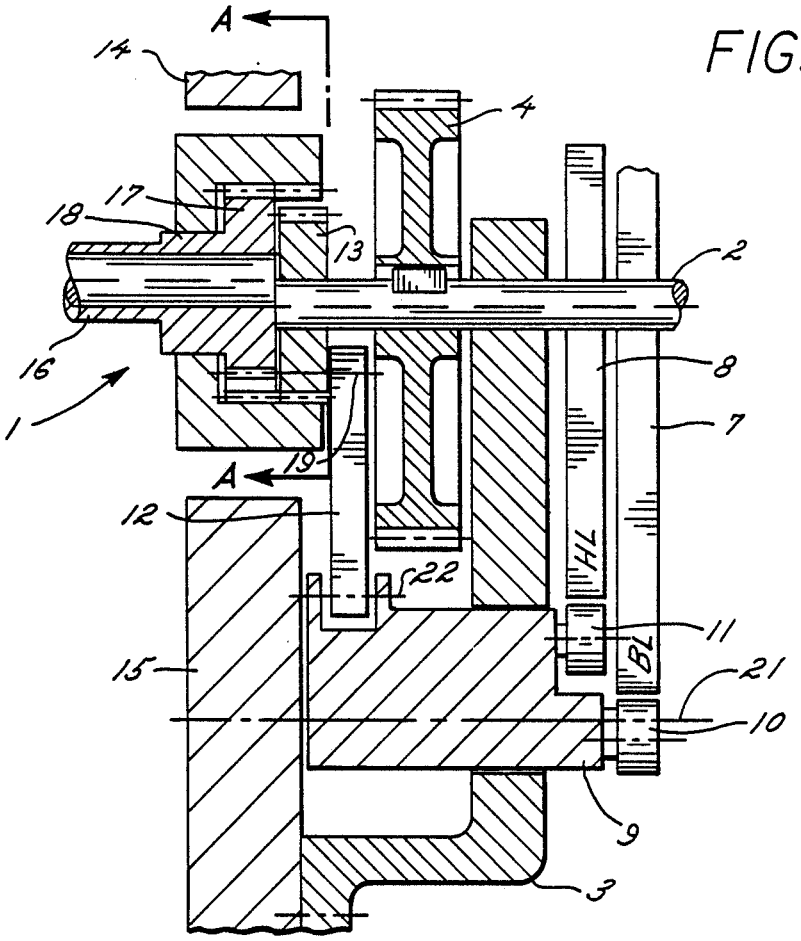
FIG. 2 is a section through the device.

Turning now to the drawings, an eccentric (intermediate drive) shaft 2 is rotatably mounted in a casing shell 3 on a side upright 15 of a printing press and also in the opposite side upright of the press (not shown). As seen in FIG. 2, a gear 4 is rigidly connected to the shaft 2 and is in permanent mesh with a drive gear (not shown) co-rotating with an impression cylinder of the press. Cams in the form of a main cam 8 and an auxiliary cam 7 are rigidly connected to the shaft 2 coaxially of the gear 4 and are positively connected by way of cam followers 10, 11 to a double cam follower lever 9. A link rod 12 is pivoted by way of an articulated connection 22 to the lever 9 and is also pivotally connected eccentrically by way of a crank pin 19 to an externally toothed gear 13 of a differential planetary transmission 1 rotatably mounted on the shaft 2. The lever 9 is rotatably mounted by way of a pivot connection 21 in the shell 3.

The gear 13 of the transmission 1 is in permanent mesh with an internally toothed gear 14 rotatably mounted on a hub 18 of a second externally toothed gear 17. The external gear 17 is rigidly secured to an auxiliary gripper shaft 16 and to the hub 18 which are mounted together for rotation on the shaft 2. The external gear 17 is also in permanent mesh with the internally toothed gear 14. The central axes of the two externally toothed gears 13, 17 of the transmission 1 are eccentrically offset from one another with the amount of the eccentricity e being the distance between their central axes.

Figure 3:
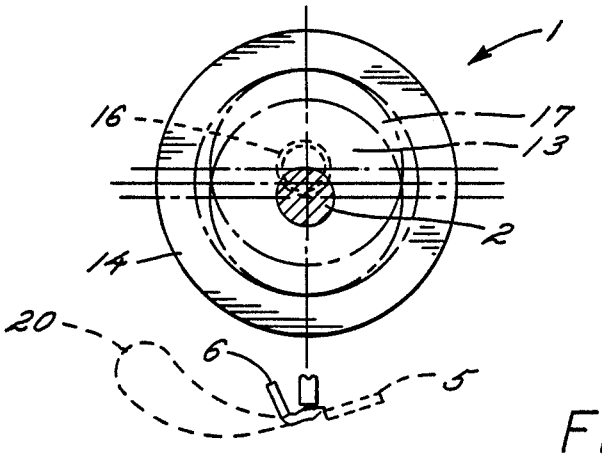
FIG. 3 is a section on the line A—A of FIG. 2.

The operation of the device will now be described as follows. The gear 4 is driven at the speed of the press and, by way of the cams 7, 8 and cam followers 10, 11, imparts to the lever 9 an oscillating rotation. This coaxially initiated additional motion is transmitted by the link rod 12 through the transmission 1 with the transmission ratio $i_o = +1$ to the auxiliary gripper shaft 16. To this end, the shaft 16 is rigidly connected on its end face to the gear 17. The gear 14 of the transmission 1 superimposes upon the orbiting movement of the shaft 2 the oscillatory rotation of the gear 13 to impart the required movement 20 at the externally toothed gear 17. The motion 20 of the shaft 16 at the gear 17 is shown in dash lines in FIG. 3.

The timing provided by the drive of the present invention ensures that grippers 6 are stationary at transfer of a sheet from a horse 5, that the sheet is transferred to the grippers (not shown) of the impression cylinder at the same speed, and that the return movement, in which the grippers 6 move away from the impression cylinder to return to their normal position and gradually return to their initial position for the transfer of a new sheet, is terminated.

It will be appreciated, of course, that the invention is not limited to the construction specifically described and illustrated herein. Instead, the motion 20 can be produced in kinetically reversed form with the use of stationary instead of rotating cams 7, 8 and a comparable differential satellite transmission coupled with a rotating four-element crank drive. What is important for the invention is that the input and output shafts, used to produce the additional motion of the auxiliary gripper shaft 16, are disposed coaxially of one another instead of far apart from one another, so that they can impose an oscillatory motion upon the continuous rotation of the lifting eccentric of the auxiliary grippers with substantially reduced mass forces.

We claim as our invention:

1. A device for driving an oscillating auxiliary gripper of a printing press having a frame including a side upright, comprising in combination, an intermediate drive shaft with an eccentric portion shaft portion having an eccentricity e, said intermediate drive shaft being rotatably mounted with respect to the side upright of the press, a cam-actuated auxiliary gripper shaft rotatably mounted on said eccentric portion for oscillation thereon, a driven gear rigidly secured to said intermediate drive shaft and meshing permanently with a drive gear that rotates with the impression cylinder of the press, a casing shell secured to said side upright, an auxiliary cam and main cam intermediate drive rigidly secured to said shaft coaxially with said driven gear and, a double cam follower lever having cam followers positively engaging said main cam and said auxiliary cam, said follower lever being pivotally mounted in said casing shell, a link rod pivotally connected to said follower lever and connected by way of a crank pin to the input side of a differential planetary transmission on whose output side said auxiliary gripper shaft is rotatably disposed for oscillation on the eccentric portion of said rotating intermediate drive shaft.

2. A device according to claim 1, wherein said differential planetary transmission includes a first externally toothed gear rotatably mounted on said intermediate drive shaft, and offset therefrom by the amount of the eccentricity e of said eccentric portion, a second externally toothed gear secured to the auxiliary gripper shaft and having an eccentric hub, and an internally toothed gear of the transmission rotatably mounted on the hub of the second externally toothed gear and in permanent mesh with the two externally toothed gears.

* * * * *